United States Patent [19]

Neveux

[11] 3,969,883

[45] July 20, 1976

[54] SPINDLE FOR FALSE TWIST BY FRICTION

[75] Inventor: Jacques Neveux, Riorges, France

[73] Assignee: Chavanoz S.A., Chavanoz, France

[22] Filed: Oct. 10, 1974

[21] Appl. No.: 513,624

[30] Foreign Application Priority Data

Oct. 19, 1973 France ..... 73.37987

[52] U.S. Cl. ..... 57/77.4; 57/34 HS; 57/51.6

[51] Int. Cl.[2] ..... D02G 1/04; D02G 1/06; D01H 7/92

[58] Field of Search ..... 57/77.3–77.45, 57/157 TS, 34 HS, 106, 51.6

[56] References Cited

UNITED STATES PATENTS

| | | | |
|---|---|---|---|
| 3,029,591 | 4/1962 | Scragg et al. | 57/77.4 X |
| 3,668,855 | 6/1972 | Leeson et al. | 57/77.4 |
| 3,670,488 | 6/1972 | Richter | 57/77.4 |
| 3,685,273 | 8/1972 | Neveux | 57/77.4 |
| 3,695,020 | 10/1972 | Richter | 57/77.4 |
| 3,701,245 | 10/1972 | Richter | 57/77.4 X |
| 3,791,122 | 2/1974 | Raschle | 57/77.45 |
| 3,875,734 | 4/1975 | Dupeuble | 57/77.4 |

FOREIGN PATENTS OR APPLICATIONS

| | | |
|---|---|---|
| 1,183,720 | 2/1959 | France |
| 1,284,485 | 1/1962 | France |
| 2,123,618 | 11/1972 | Germany |
| 698,343 | 11/1965 | Italy |
| 857,872 | 1/1961 | United Kingdom |

*Primary Examiner*—John Petrakes
*Attorney, Agent, or Firm*—H. William Petry

[57] ABSTRACT

The invention relates to a new spindle for false twist by friction.

This spindle contains two hollow elements with parallel axes, rotating in opposite directions, equipped at their ends with friction elements, and it is characterized by the fact that it also contains at least one member for guidance and return of the thread positioned between the rotary hollow cylindrical elements, and which does not stop the twist imparted to the thread by the friction elements, the axis of this guidance and return member being offset with respect to a plane containing the longitudinal axes of the hollow cylindrical elements, and the plane in which the thread is contained as it passes around the guidance and return member intersecting the plane formed by the longitudinal axes of the hollow cylindrical elements.

This spindle is particularly applicable in the high-speed false-twist texturing of synthetic threads.

6 Claims, 2 Drawing Figures

SPINDLE FOR FALSE TWIST BY FRICTION

Figure 1:
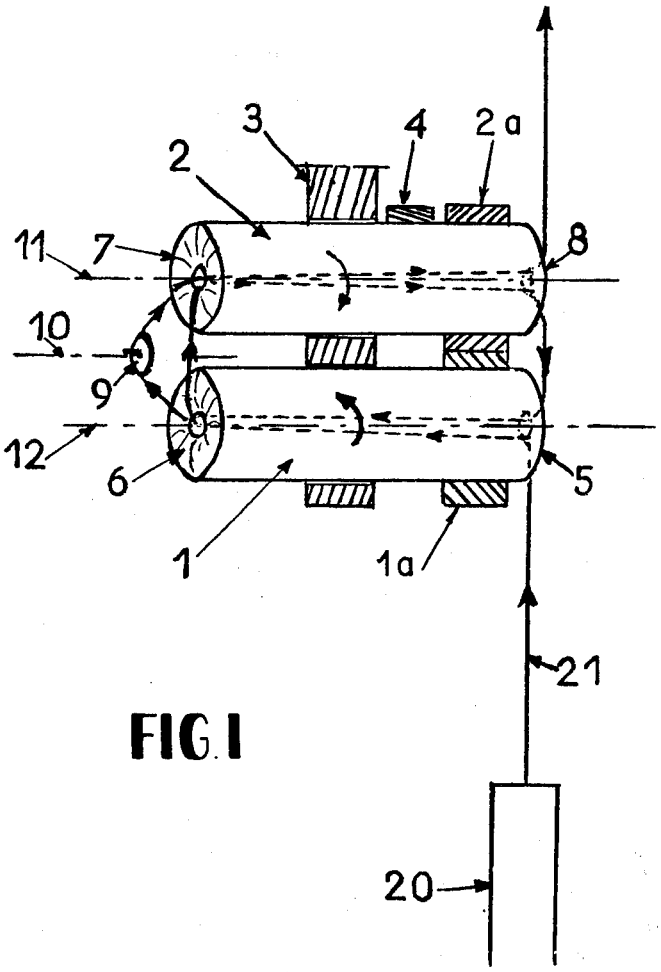

The present invention relates to a new spindle for texturization of a thread by false twist by friction.

Devices are known which make it possible to impart, by friction, a false twist to a thread in movement. One of the most widespread devices for imparting a false twist by friction to a thread is composed essentially of two hollow, cylindrical elements, with parallel axes, rotating in opposite directions, equipped at their ends with friction elements, the thread passing successively inside the cylinders and rubbing against the friction elements. These devices, which are described in particular in French Pat. No. 1,284,485 and Italian Pat. No. 698,343, have certain drawbacks, however, owing to the fact that the thread in movement can be placed in contact with no more than four successive friction surfaces.

It has been found that, for certain types of thread, and in particular for threads of high denier, for example for polyester threads whose denier is higher than 167 decitex (150 deniers), it was preferable to put them in contact with a larger number of friction surfaces. Moreover, owing to the increased treatment speeds, particularly when it is desired to draw or stretch the thread simultaneously with the texturation, it has also been found that best results are not obtained if the thread were placed in contact with only four friction elements.

There have consequently been plans to multiply the friction surfaces in order to overcome these drawbacks, and for this, devices have been developed having more than two rotary hollow elements or tubes, equipped at their ends with friction elements. Thus, French Pat. No. 1,183,720 describes a device having three parallel rotary tubes, each equipped with friction elements. German DOS No. 2,123,618 also describes a device of this type having three parallel rotary tubes equipped in this case with friction elements at each of their ends.

Such devices have many drawbacks, the principal ones being large bulk, and more complicated, hence more troublesome, maintenance and manufacture, owing to the larger number of moving parts.

It has now been discovered, and this forms the object of the invention, a device for false twist by friction, formed of only two hollow cylindrical elements, with parallel axes, rotating in opposite directions, equipped at their ends with friction elements, which make it possible to bring the thread in contact more than once with each of the friction surfaces.

According to one embodiment of the invention, the device permits passing the thread at least twice over each of the friction surfaces, which corresponds, in reality, to bringing it in contact with the equivalent of at least eight friction surfaces. Furthermore, the device according to the invention permits, if desired, the varying of the path of the thread between the two hollow cylindrical elements; thus the thread can be cooled to a greater or lesser degree before passing from one hollow cylindrical element to the other.

In order to achieve these results, the spindle for false twist by friction according to the ivention comprises two hollow cylindrical elements with parallel axes, rotating in opposite directions, equipped at their ends with friction elements, and characterized by the fact that it contains at least one guidance and return member for the thread positioned between the rotary, hollow cylindrical elements, which member does not stop the twist imparted to the thread by the friction elements. The axis of this guidance and return member is offset with respect to a plane containing the longitudinal axes of the hollow cylindrical elements, the plane in which the thread is contained as it passes around the guidance and return member intersecting the plane formed by the longitudinal axes of the hollow cylindrical elements.

In a preferred form of embodiment of the invention, the guidance and return member is fixed, and has substantially the form of a grooved pulley which will be designated by the term "diabolo" in the remainder of the description, the central axis of this diabolo being substantially parallel to the longitudinal axes of the hollow cylindrical elements, and the diabolo being situated substantially at the same level as the ends of the hollow cylindrical elements.

According to the invention, the diabolo must not stop the twist imparted by the friction elements, and it has been determined that it should have, as a basis, a hard and polished material surface. Its diameter can vary according to the material used. For example, there can be used a diabolo of ceramic, such as Tital T 8 C, the diameter in this case being larger than 10 mm. The diabolo can either be placed between the outlet from the first hollow cylindrical element and the entry to the second, or, on the contrary, between the outlet of the second hollow cylindrical element and the entry to the first. Preferably the diabolo will be mounted on an adjustable support which makes it possible to vary its distance with respect to the hollow cylindrical elements, but this distance should not be less than 1 centimeter. Finally, the hollow cylindrical elements can be placed vertically, but will preferably be horizontal.

Figure 2:
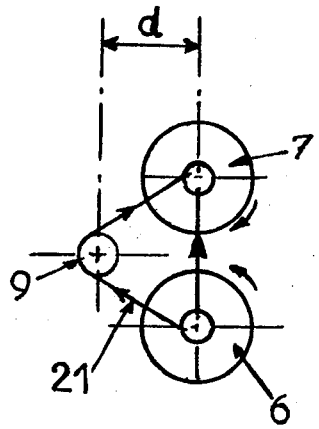

The invention will be better understood with the aid of the example of the invention given below, and the accompanying drawings, FIG. 1 of which shows the false twist device as a whole in schematic perspective, and FIG. 2 of which is a schematic side view of the device.

The false twist spindle is composed of two hollow cylindrical elements 1, 2, which are supportably mounted horizontally in parallel side-by-side relation for rotation in a support bushing 3 attached to the frame (not shown) of a false-twist texturing machine. A disengageable belt 4 drives element 2 in rotation and it, in turn, drives element 1 at the same speed but in the opposite direction by suitable force-transmitting means, such as engageable elements 1*a*, 2*a*. The hollow cylindrical elements 1 and 2 are equipped at each of their ends with friction elements (rings), 5, 6, 7, and 8 having a smooth, convex inner surface. According to the invention, the spindle also has a guidance and return member 9 for the thread, this member being a diabolo having the form of a grooved pulley. The rotational axis 10 of this diabolo 9 is offset with respect to the longitudinal axes 11 and 12 of the hollow cylindrical elements 2 and 3. This diabolo 9 is fixedly mounted on an adjustable support, not shown, which makes it possible to vary its distance *d* (FIG. 2) with respect to the hollow cylindrical elements.

In this example, the diabolo 10 is positioned vertically between the outlet from element 1 and the entry to element 2, and substantially at the same level as the ends of these elements 1 and 2. This diabolo is made of Tital type T 8 C, and has a diameter of 12 mm; it is placed at a distance *d* with respect to the axes 11 and 12, equal to one centimeter.

From the outlet of a thread heater 20, the thread 21 enters hollow cylindrical element 1, rubs against the friction surfaces 5 and 6, passes around diabolo 9, enters hollow sylindrical element 2, and rubs against friction surfaces 7 and 8. The thread is then passed again through elements 1 and 2, rubbing once more against friction surfaces 5, 6, 7, and 8, but this time does not pass around the diabolo. On leaving, the thread continues its travel in conventional fashion through the other elements of the texturing machine (not shown) before being wound on a take-up package. By provision of the guidance and return diabolo, the thread has therefore come in contact two times with each of the friction elements 5, 6, 7, and 8, without risk of tangling of the threads.

In this manner there is treated, successfully, a polyester thread of 167 detex/34 strands, semi-drawn, on a machine for simultaneous texturization and drawing, equipped with a spindle according to the invention. The conditions of texturization were as follows:

linear speed: 390 meters per minute
residual drawing rate: 1.62
speed of the friction elements: 34,650 rpm.

The thread obtained has an elasticity of 186%, was very uniform and had remarkable qualities from the point of view of hand or swelling.

It is clear that the example given above is non-limiting, and that one will not depart from the invention if more than one thread guidance and return element is employed between the two hollow cylindrical friction elements and/or if the spacing of the guidance and return element relative to the friction elements is increased or diminished. Thus, for example, there could be used two offset guidance and return elements, which would make it possible to place the thread in contact with each of the friction elements three times.

That which is claimed is:

1. In a device for false twisting a moving textile yarn by friction including two hollow cylindrical elements positioned in generally side-by-side relation with their axis substantially parallel and mounted for rotation in opposite directions, said elements being equipped at all their ends with friction elements for engaging a yarn strand passing therethrough to impart twist to the yarn during rotation of the elements, the improvement comprising at least one thread guidance and return means positioned adjacent one end of the hollow rotary cylindrical elements for directing the yarn strand at least twice into engagement with each of said friction elements to impart twist thereto, and said means is offset with respect to a plane containing the longitudinal axes of the hollow cylindrical elements whereby the plane in which the thread is contained at the time of its passage about said thread engaging surface of the guidance and return means intersects the plane formed by the longitudinal axes of the hollow cylindrical elements.

2. A device as defined in claim 1, wherein said guidance and return means comprises a fixed grooved pulley, the central axis of which is substantially parallel to the longitudinal axes of the hollow cylindrical elements, said pulley being positioned substantially in a plane containing said one end of each of the hollow cylindrical elements.

3. A device as defined in claim 1, wherein said thread engaging surface is made of ceramic material and has a diameter greater than about 10 mm.

4. A device as defined in claim 1, wherein said guidance and return means is positioned to direct the yarn strand from engagement with a friction element of one of said hollow cylindrical element to engagement with a friction element of the other of said hollow cylindrical elements.

5. A device as defined in claim 1 including means for adjustably positioning said guidance and return means with respect to the hollow cylindrical elements.

6. A device as defined in claim 1 wherein said guidance and return means is off-set from the plane containing the longitudinal axes of the hollow cylindrical elements by at least 1 centimeter.

* * * * *